US005809581A

United States Patent [19]

Brown

[11] Patent Number: 5,809,581

[45] Date of Patent: Sep. 22, 1998

[54] ODOR-LESS TOILET SYSTEM

[76] Inventor: Ronald S. Brown, 130 Lyons La., South Shore, Ky. 41175

[21] Appl. No.: 799,379

[22] Filed: Feb. 14, 1997

[51] Int. Cl.[6] ..... E03D 9/04

[52] U.S. Cl. ..... 4/213; 4/209 R

[58] Field of Search ..... 4/213, 209 R

[56] References Cited

U.S. PATENT DOCUMENTS

| | | | |
|---|---|---|---|
| 1,955,579 | 4/1934 | De Malaussene | 4/213 |
| 2,329,221 | 9/1943 | Sanford | 4/213 |
| 3,495,282 | 2/1970 | Taggart | 4/213 |
| 4,165,544 | 8/1979 | Barry | 4/213 |
| 4,882,790 | 11/1989 | Ricard | 4/213 |
| 5,259,072 | 11/1993 | Trombley | 4/213 |

*Primary Examiner*—David J. Walczak

[57] ABSTRACT

A new Odor-Less Toilet System for drawing odors from a toilet bowl and not allowing them to escape into the bathroom. The inventive device includes air intake ports integrally formed in a toilet bowl rim in fluid flow communication with an exhaust chamber.

1 Claim, 4 Drawing Sheets

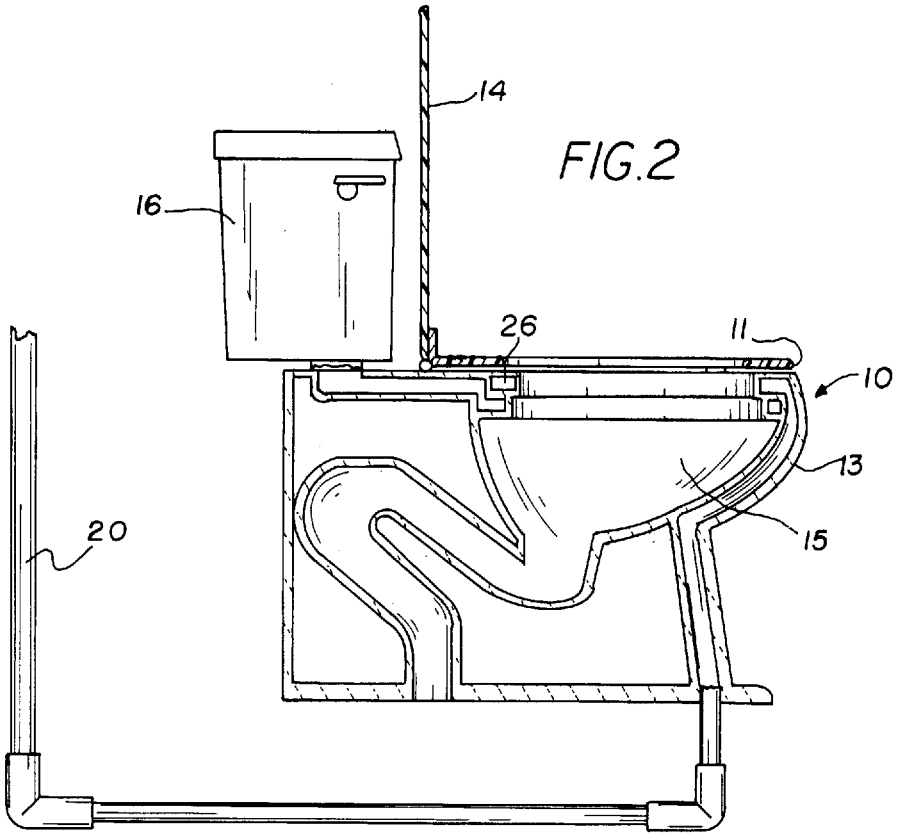
FIG.2
FIG.3
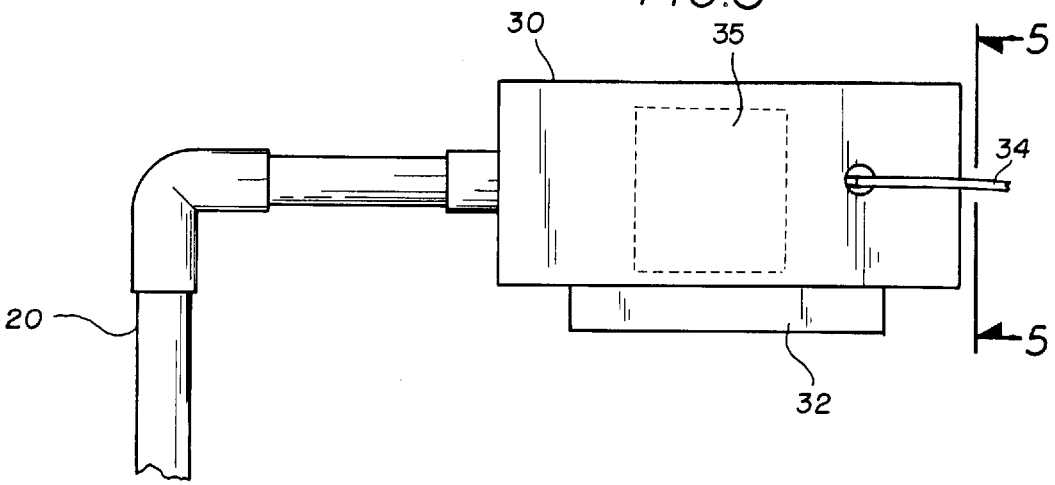

ODOR-LESS TOILET SYSTEM

BACKGROUND OF THE INVENTION

1. Field of the Invention

The present invention relates to ventilated toilets and more particularly pertains to a new Odor-Less Toilet System for drawing odors from a toilet bowl and not allowing the odors to escape into the bathroom.

2. Description of the Prior Art

The use of ventilated toilets is known in the prior art. More specifically, ventilated toilets heretofore devised and utilized are known to consist basically of familiar, expected and obvious structural configurations, notwithstanding the myriad of designs encompassed by the crowded prior art which have been developed for the fulfillment of countless objectives and requirements.

Known prior art ventilated toilets include U.S. Pat. Nos. 4,617,687; 4,175,293; 5,355,536; 5,161,262; and 5,125,119.

While these devices fulfill their respective, particular objectives and requirements, the aforementioned patents do not disclose a new Odor-Less Toilet System. The inventive device includes air intake ports integrally formed in a toilet bowl rim in fluid flow communication with an exhaust chamber.

In these respects, the Odor-Less Toilet System according to the present invention substantially departs from the conventional concepts and designs of the prior art, and in so doing provides an apparatus primarily developed for the purpose of drawing odors from a toilet bowl and not allowing them to escape into the bathroom.

SUMMARY OF THE INVENTION

In view of the foregoing disadvantages inherent in the known types of ventilated toilets now present in the prior art, the present invention provides a new Odor-Less Toilet System construction wherein the same can be utilized for drawing odors from a toilet bowl and not allowing them to escape into the bathroom.

The general purpose of the present invention, which will be described subsequently in greater detail, is to provide a new Odor-Less Toilet System apparatus and method which has many of the advantages of the ventilated toilets mentioned heretofore and many novel features that result in a new Odor-Less Toilet System which is not anticipated, rendered obvious, suggested, or even implied by any of the prior art ventilated toilets, either alone or in any combination thereof.

To attain this, the present invention generally comprises air intake ports integrally formed in a toilet bowl rim in fluid flow communication with an exhaust chamber.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Odor-Less Toilet System apparatus and method which has many of the advantages of the ventilated toilets mentioned heretofore and many novel features that result in a new Odor-Less Toilet System which is not anticipated, rendered obvious, suggested, or even implied by any of the prior art ventilated toilets, either alone or in any combination thereof.

It is another object of the present invention to provide a new Odor-Less Toilet System which may be easily and efficiently manufactured and marketed.

It is a further object of the present invention to provide a new Odor-Less Toilet System which is of a durable and reliable construction.

An even further object of the present invention is to provide a new Odor-Less Toilet System which is susceptible of a low cost of manufacture with regard to both materials and labor, and which accordingly is then susceptible of low prices of sale to the consuming public, thereby making such Odor-Less Toilet System economically available to the buying public.

Still yet another object of the present invention is to provide a new Odor-Less Toilet System which provides in the apparatuses and methods of the prior art some of the advantages thereof, while simultaneously overcoming some of the disadvantages normally associated therewith.

Still another object of the present invention is to provide a new Odor-Less Toilet System for drawing odors from a toilet bowl and not allowing them to escape into the bathroom.

Yet another object of the present invention is to provide a new Odor-Less Toilet System which includes air intake ports integrally formed in a toilet bowl rim in fluid flow communication with an exhaust chamber.

Still yet another object of the present invention is to provide a new Odor-Less Toilet System that is easy to install.

Even still another object of the present invention is to provide a new Odor-Less Toilet System that operates quietly.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is a cross sectional view of the present invention.

FIG. 3 is a view of the conduit and exhaust chamber of the present invention.

DESCRIPTION OF THE PREFERRED EMBODIMENT

Figure 1:
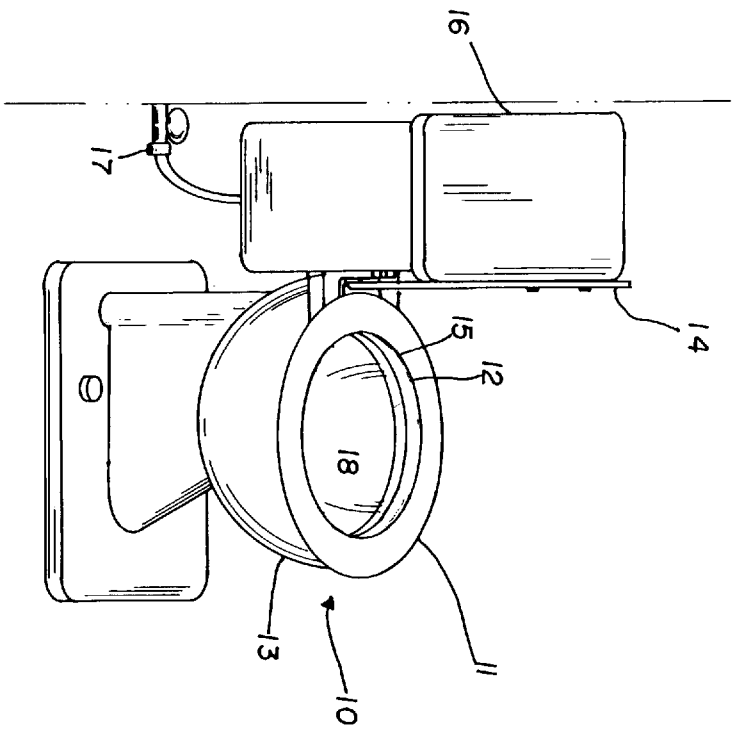
FIG. 1 is a left side perspective view of a new Odor-Less Toilet System according to the present invention.

With reference now to the drawings, and in particular to FIGS. 1 through 8 thereof, a new Odor-Less Toilet System embodying the principles and concepts of the present invention and generally designated by the reference numeral 10 will be described.

More specifically, it will be noted that the Odor-Less Toilet System 10 comprises air intake ports 27 integrally formed in a toilet bowl rim 12 in fluid flow communication with an exhaust chamber 30.

Figure 7:
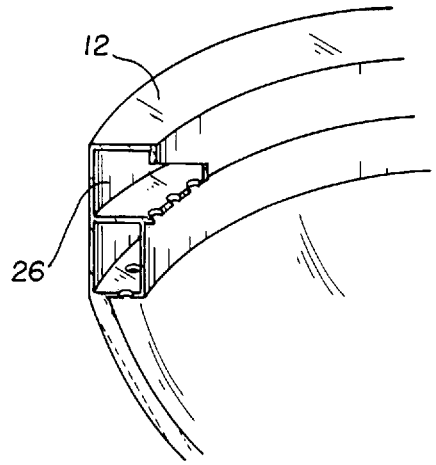
FIG. 7 is a cross sectional view of the toilet bowl rim showing the air chamber and the water chamber.
Figure 8:
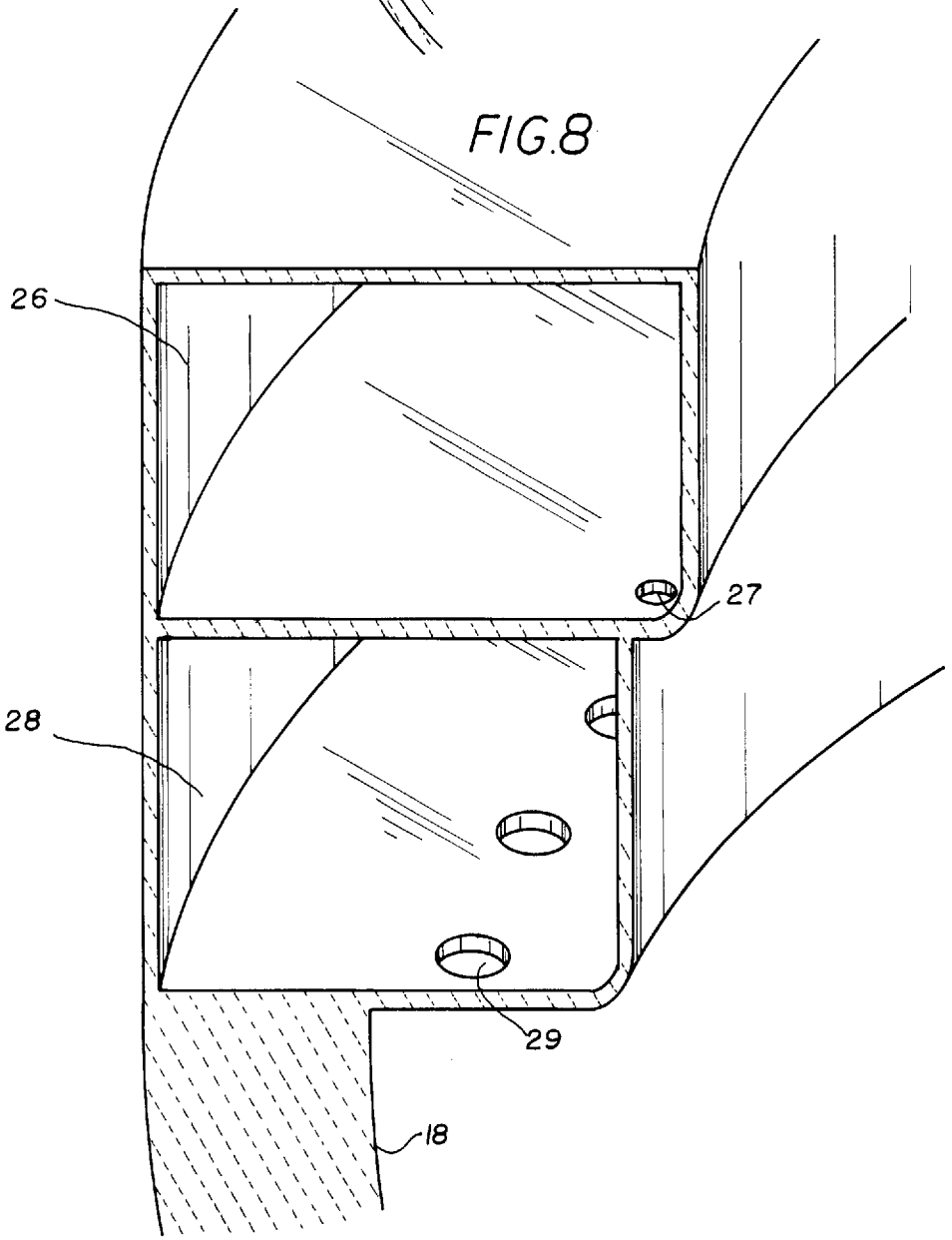
FIG. 8 is a cross sectional view of the toilet bowl rim showing the air intake ports and water outlet ports.

With reference to FIG. 1 there is shown a toilet comprising a toilet bowl 15 including a toilet bowl outside surface 13 and a toilet bowl inside surface 18. The toilet bowl 15 has an upper rim portion and a lower rim portion. The upper rim portion has a lower surface disposed outwardly from a top of the lower rim portion. The toilet bowl 15 further comprises a toilet bowl rim 12 having an air chamber 26 having a plurality of air intake ports 27 in fluid flow communication with an inside of the toilet bowl 15 and a conventional water chamber 28 disposed thereunder having a plurality of water outlet ports 29 (FIG. 7). The toilet is shown equipped with a toilet seat 11, toilet seat lid 14, and water tank 16 supplied with water from water supply 17.

With reference to FIGS. 2 and 3 the air chamber 26 is shown in fluid flow communication with conduit means 20 formed from polyvinyl chloride or other suitable material. Conduit means 20 is disposed in front of the toilet and runs up inside a wall (not shown) to an exhaust chamber 30 located in an attic. Conduit means 20 is in fluid flow communication with the exhaust chamber 30. Preferably, the toilet bowl is structured to have an air duct in fluid communication with the hollow upper rim interior. The air duct leads away from the hollow upper rim interior to a conduit 20. The conduit 20 leads to an air exhaust port 30.

Figure 4:
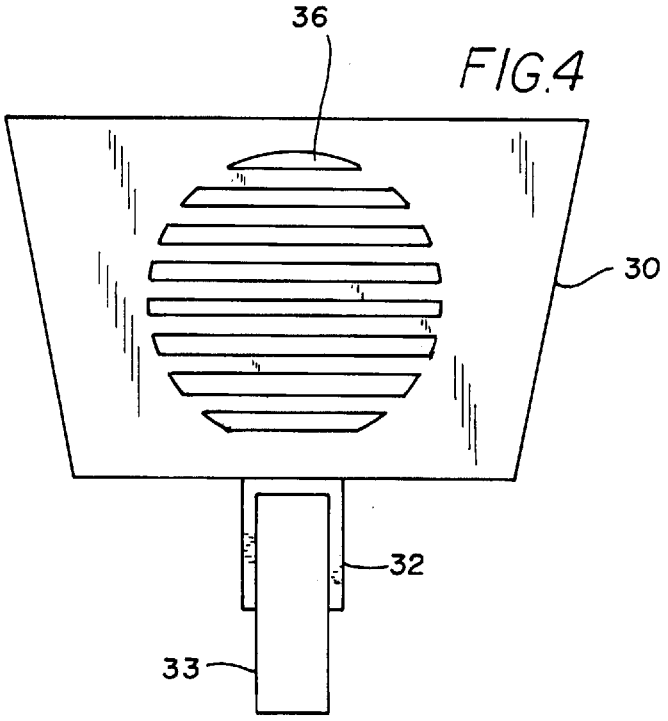
FIG. 4 is a plan view along line 5—5 of FIG. 3.
Figure 5:
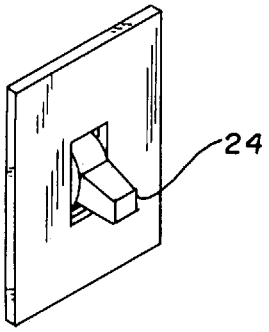
FIG. 5 is a view of a switch.

The exhaust chamber 30 includes a fan 35 electrically connected to a source of power by means of an electrical power cord 34. The exhaust chamber 30 mounts to a ceiling beam 33 by means of mounting bracket 32 (FIG. 4). An exhaust port 36 is provided to exhaust the air into the atmosphere.

Figure 6:
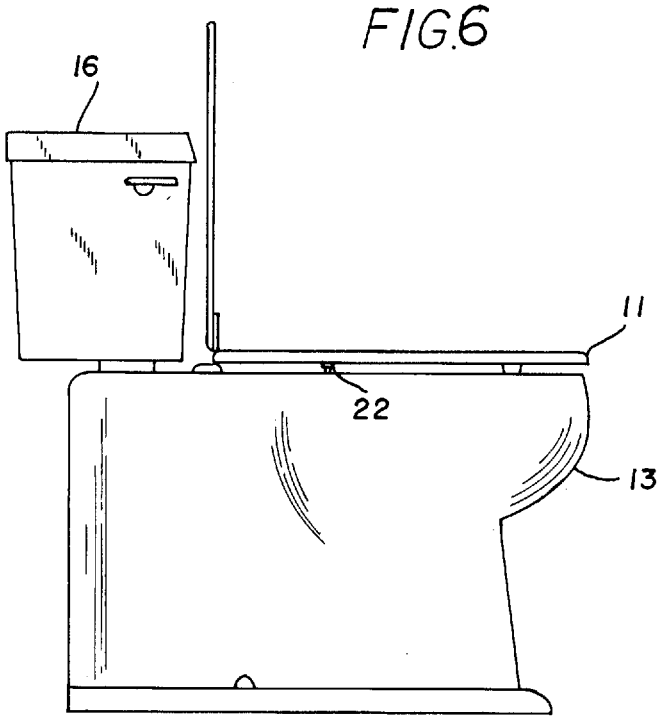
FIG. 6 is a view of an alternative embodiment of the present invention showing a pressure sensitive switch.

An on/off switch 24 (FIG. 5) controls the operation of the fan and is located within reach of the toilet. Alternatively, the fan can be controlled by means of well known motion sensing devices such as infra-red sensors and microwave sensors or by means of a pressure sensitive switch 22 shown disposed under the toilet seat 11 which is switched upon a downward pressure being exerted upon the toilet seat 11 (FIG. 6).

In use, a person using the Odor-Less Toilet System switches on the fan located in the exhaust chamber 30 by means of either the on/off switch 24 or by exerting pressure upon the toilet seat 11 which switches pressure sensitive switch 22. Alternatively, an automatic motion sensing device senses that the toilet is in use and turns on the fan. The fan draws air from inside the toilet bowl through air intake ports 27, air chamber 26, conduit 20, exhaust chamber 30 and out into the atmosphere through exhaust port 36.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An odorless toilet system comprising:

a toilet bowl having an upper rim portion and a lower rim portion;

the upper rim portion having a lower surface disposed outwardly from a top of the lower rim portion;

the upper rim portion being structured to include a hollow upper rim interior and a plurality of apertures, the apertures positioned in the lower surface of the upper rim portion such that the hollow upper rim interior is in fluid communication with the toilet bowl;

the lower rim portion being structured to have a hollow lower rim interior which is not in fluid communication with the upper rim portion, the lower rim portion further having a plurality of holes, the holes positioned to lead from the hollow lower rim interior into the toilet bowl;

the hollow lower rim interior being selectively in fluid communication with a toilet bowl tank such that manipulation of a toilet actuator releases fluid from the toilet bowl tank into the hollow lower rim interior and then into the toilet bowl through the holes in the lower rim portion;

the toilet bowl being structured to have an air duct in fluid communication with the hollow upper rim interior, the air duct leading away from the hollow upper rim interior to a conduit, the conduit leading to an air exhaust port; and a fan positioned within the conduit proximate the exhaust port such that the fan facilitates fluid flow through the conduit and out of the exhaust port.

* * * * *